US007743471B2

(12) United States Patent
Rogers

(10) Patent No.: US 7,743,471 B2
(45) Date of Patent: Jun. 29, 2010

(54) REMOVABLE HAT ACCESSORY

(75) Inventor: James R. Rogers, Rancho Cucamonga, CA (US)

(73) Assignee: Namkung Promotions Inc., Costa Mesa, CA (US)

( * ) Notice: Subject to any disclaimer, the term of this patent is extended or adjusted under 35 U.S.C. 154(b) by 928 days.

(21) Appl. No.: 11/438,046

(22) Filed: May 19, 2006

(65) Prior Publication Data

US 2006/0288538 A1 Dec. 28, 2006

Related U.S. Application Data

(63) Continuation-in-part of application No. 11/145,882, filed on Jun. 6, 2005, now Pat. No. 7,389,567, which is a continuation-in-part of application No. 10/645,368, filed on Aug. 21, 2003, now Pat. No. 7,350,274.

(51) Int. Cl.
*A44B 1/38* (2006.01)

(52) U.S. Cl. ..... 24/3.12; 24/113 MP

(58) Field of Classification Search ..... 24/3.12, 24/458, 3.11, 66.13, 545, 563, 113 R, 113 MP, 24/90.5; 2/209.13, 209.14
See application file for complete search history.

(56) References Cited

U.S. PATENT DOCUMENTS

| | | | |
|---|---|---|---|
| 2,611,902 | A | 9/1952 | Rockmore |
| 3,077,051 | A | 2/1963 | Quinones, Jr. |
| 3,106,184 | A | 10/1963 | Shea |
| 5,070,546 | A | 12/1991 | Stazo et al. |
| 5,088,127 | A | 2/1992 | Thornock |
| D325,941 | S | 5/1992 | Bertrand |
| D356,205 | S | 3/1995 | Amato |
| D365,916 | S | 1/1996 | Hutchinson et al. |
| D366,751 | S | 2/1996 | Gravante |
| D370,333 | S | 6/1996 | Lewis |
| 5,530,970 | A | 7/1996 | Knutson |
| 5,561,864 | A | 10/1996 | DeMars |
| D376,468 | S | 12/1996 | Berman |
| D391,389 | S | 3/1998 | Ramirez, Jr. |
| 5,734,991 | A | 4/1998 | Schmid |

(Continued)

*Primary Examiner*—James R Brittain
(74) *Attorney, Agent, or Firm*—Stetina Brunda Garred & Brucker

(57) ABSTRACT

An attaching device for removably attaching various types of display objects to a hat. The attaching device has a fastener for engaging with the display object and a spring member for retaining the fastener therein and attaching to a button of the hat. The fastener is in the form of a plastic ring with a plurality of tabs projecting from a bottom rim thereof. The spring member has an upper spring portion, a lower spring portion and a joint spring portion connecting the upper and lower spring portions. The upper spring portion has an inner perimeter substantially the same as the maximum radial extent of the tabs, such that the plastic ring can be inserted therein. A plurality of protrusions is formed to extend inwardly from the inner perimeter of the upper spring portion. The protrusions are outline with a profile mating that of the tabs, such that the plastic ring can be secured interlocked with the spring member. The lower spring portion has an open end split into two parallel leaves, such that, by bending the joint spring to open the space between the upper and lower spring portions, the spring member can slide towards the button to receive the button within the space between the upper and lower spring portions.

7 Claims, 3 Drawing Sheets

U.S. PATENT DOCUMENTS

| | | | | |
|---|---|---|---|---|
| 5,771,493 | A | 6/1998 | Proctor | |
| D397,839 | S | 9/1998 | Lettieri | |
| D399,037 | S | 10/1998 | Davis, III | |
| 5,896,585 | A | 4/1999 | Stazo | |
| 5,903,927 | A | 5/1999 | Wolfe et al. | |
| D410,318 | S | 6/1999 | Chen | |
| D410,690 | S | 6/1999 | Pratt et al. | |
| 6,003,207 | A * | 12/1999 | Homma | 24/3.12 |
| 6,049,912 | A | 4/2000 | Linehan | |
| 6,094,749 | A | 8/2000 | Proctor | |
| 6,161,259 | A * | 12/2000 | Rabenecker | 24/3.11 |
| 6,279,167 | B1 | 8/2001 | Johnson et al. | |
| D454,678 | S | 3/2002 | Graves et al. | |
| 6,421,885 | B1 * | 7/2002 | Mowers et al. | 24/3.12 |
| 7,063,244 | B2 * | 6/2006 | Lee et al. | 224/271 |
| 2003/0051317 | A1 * | 3/2003 | Preziosi et al. | 24/3.12 |
| 2005/0039308 | A1 * | 2/2005 | Rogers | 24/113 R |

* cited by examiner

REMOVABLE HAT ACCESSORY

CROSS-REFERENCE TO RELATED APPLICATIONS

This invention is a continuation-in-part of an earlier filed application Ser. No. 11/145,882, entitled "Removable Hat Accessory" filed Jun. 6, 2005, now U.S. Pat. No. 7,389,567 which is a continuation-in-part of an earlier filed application Ser. No. 10/645,368, entitled "Removable Hat Accessory" filed Aug. 21, 2003, now U.S. Pat. No. 7,350,274, the disclosures of which are expressly incorporated herein by reference.

STATEMENT RE: FEDERALLY SPONSORED RESEARCH/DEVELOPMENT

Not Applicable

BACKGROUND

The invention relates in general to hat accessories, and more particularly, to an attaching device allowing various types of display or ornamental object to be removably attached to a button found on conventional hats/caps.

In order to make the hats more visually appealing for various reasons such as displaying promotions and comedic effect, many hats, especially baseball-style caps, typically include a central button at their apex. The central button provides convenient means of attaching various accessories to the hat.

Many products have been designed to attach accessories to the button on top of a hat or a cap. For instances, in U.S. Pat. No. 5,530,970, Knutson discloses a display object attached to a spring. By rotation and pressing the spring against the hat button, one or more of the spring coils advances past the button and restores its original dimension underneath the button. As such, interference between the button and the bottom coils of the spring secures the device to the hat.

Also, in U.S. Pat. No. 5,070,546, Stazo discloses a device with a thin-walled bottom member that includes a hole with slits or slots radially extending therefrom. The slits or slots allow the portion of the bottom member surrounding the hole to deform when pushing the button into the hole. Such deformation allows the button to advance past the bottom member, and then the bottom member returns to its original shape. Thus, interference between the bottom member and the button secures the device to the hat. Both the Knutson and Stazo patents disclose objects that can be removably attached to the button of a hat/cap due to interference between the button and the patented device itself. However, as both Knutson and Stazo require members that locally flex in order to achieve an interference fit, repeated attachment and removal of the device, that is, repeated flexure can eventually lead to failure of the devices. For instance, since the same coil spring of the Knutson device must cyclically flex during attachment and removal, repeatedly attaching and detaching the device can cause the coil to permanently deform to an extent that the diameter of the coil is larger than the diameter of the button. Likewise, repeated attachment and detachment of the Stazo device can eventually fracture the portion of the bottom member. In both cases, a secure interference fit between the respective devices is compromised.

Therefore, there exists a substantially need in the art for a hat/cap accessory that can be easily and repeatedly attached to and removed from a button of the cap by more reliable attaching/detaching mechanism.

BRIEF SUMMARY

A removable hat attaching device is provided for removably attaching various types of objects to a hat. The attaching device includes a fastener for holding the display object and a spring member for retaining the fastener therein and to attach to a button of a cap or a hat. In one embodiment, the fastener is in the form of a plastic ring to be embedded engaged with a bottom portion of the display object. Various fastening or locking means can be used to secure the attachment between the plastic ring and the display object. For example, a plurality of fins may be formed to project from a top rim of the plastic ring, and the display object may includes a recessed bottom portion and a plurality of mating slots formed on the sidewall of recessed bottom portion. By engaging the projection fins with the slots, the display object can thus be detachably interlocked with each other. Other fastening mechanism such as frictional fit or interlocking structure can also be used. When a permanent attachment is preferred, glue or other adhesive can be used between the fastener and the display object.

As mentioned above, the attaching device further comprises a spring member formed to attach to the button of the hat. The spring member preferably includes an upper spring portion in the form of a ring for retaining the fastener therein and a lower spring portion having a proximal end connected to the upper spring. In one embodiment, the fastener includes a plurality of tabs radially projecting from a bottom rim of the plastic ring. Each of the tabs is configured with a centrally recessed profile. The upper spring portion has an inner perimeter larger than the outer perimeter of the plastic ring. A plurality of protrusions is formed to extend inwardly from the inner perimeter of the upper. The protrusions are preferably configured with a profile for mating with the tabs. Therefore, when the fastening ring is inserted within the upper spring, the engagement between the tabs and the protrusions provides a secure attaching between the fastener and the spring member. The fastener further comprises a flange encircling the fastening ring about a bottom rim thereof. The flange extends from the bottom rims of the tabs and thus connected to the bottom rim of the fastening ring thereby. The inner perimeter of the upper spring portion is preferably smaller than the perimeter of the flange, such that the fastener is firmly secured to the hat when the spring member is attached to the button of the hat.

The upper spring portion and the lower spring portion are connected to each other by a joint spring portion. Preferably, the distal end of the lower spring portion is in the form of a two-leaf spring. The leaves are parallel to each other and operative to extend through the bottom side of the button of the hat through two opposing sides thereof. The distal ends of the leaves are preferably curved upwardly to avoid loose attachment. To attach the hat accessory to the hat, the leaves of the lower spring portion are positioned at two opposing sides of the button and subsequently slid towards the button. To accommodate the button between the upper spring portion and the lower spring portion, the joint spring portion is slightly bent or flexed to enlarge the space between the upper spring portion and the lower spring portion. When the button is positioned within the fastening ring, the joint spring portion is released to return to its original position, so as to allow the spring force to properly hold the button between the upper and lower spring portions.

In one embodiment, the spring member can be used as an attaching device directly for removable attaching a display object to the button of the hat. Similarly, the spring member includes an upper spring portion, a lower spring portion, and a joint spring portion to connect the upper spring portion and the lower spring portion. The lower spring portion has one distal end in the form of two parallel leaves to extend underneath the button of the hat until the button is aligned under the space defined by the upper spring portion and the lower spring portion and one proximal end connected to the upper spring portion via the joint spring portion. Preferably, without the application of any external force, the space between the upper spring portion and the lower spring portion is substantially the same or slightly smaller than the height of the button. Therefore, to allow the lower spring portion to slide through the button from underneath, the joint spring portion is slightly bent or flexed to enlarge the space. When the button is received within space, the joint spring portion is released, and the restoration force exerted from upper and lower spring portions will press against the button within the space. Therefore, the spring member is prevented from sliding away from the button of the hat.

The display object to be attached to the hat includes a slot recessed from at a bottom surface thereof for receiving at least the upper spring portion of the spring member therein. Preferably, the display object can be split into two lateral mating parts each having a bottom surface configured to form half of the slot. Therefore, by aligning the half slots with two opposing sides of the upper spring portion and approaching the lateral portions towards each other, the upper spring portion is embedded within the display object. To provide a more stable and secure attachment between the display object and the spring member, the slot is configured to receive both the upper spring portion and the joint spring portion of the spring member. Interlocking means such as projecting posts and mating sleeves can be formed at the interior of the respect lateral portions, so as to ensure the integrity of the display object and to secure the attachment between the display object and the spring member.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
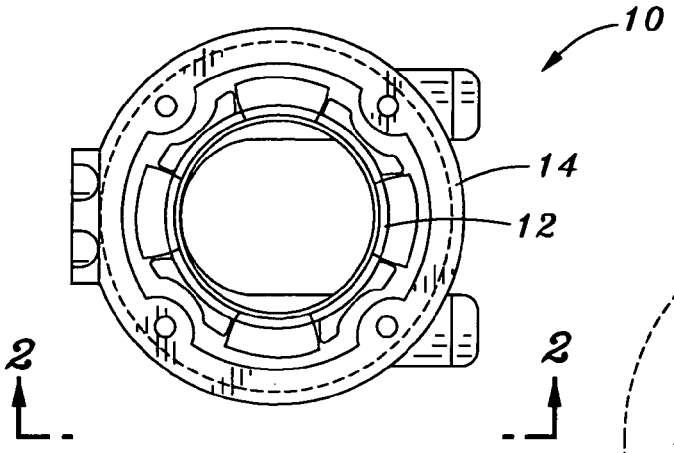
FIG. 1 shows a top view attaching device for removably attaching an object to a button of a hat.
Figure 2:
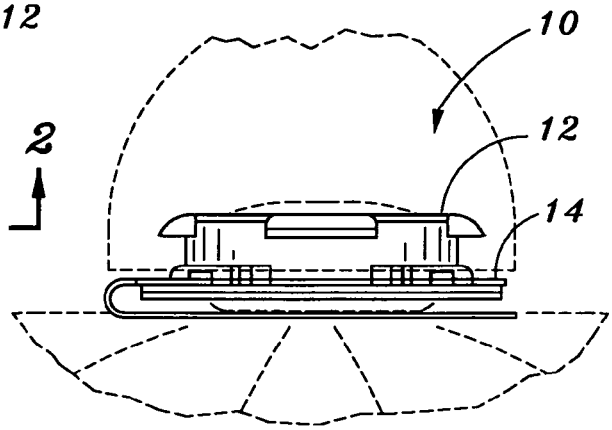
FIG. 2 shows a side view of the attaching device.
Figure 3:
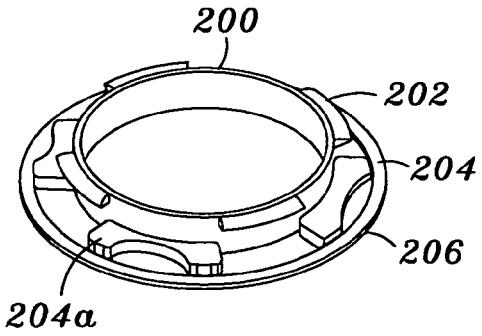
FIGS. 3-6 shows various views of a fastener of the attaching device as shown in FIGS. 1 and 2.
Figure 4:
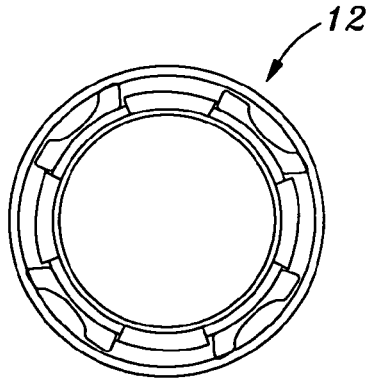
Figure 5:
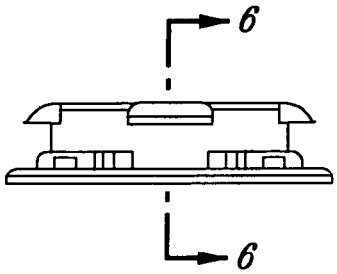
Figure 6:
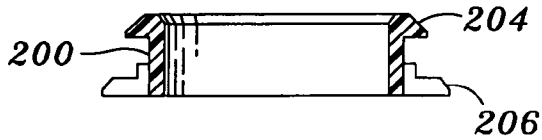

An attaching device for removably attaching a display object to a button of a hat or a cap is provided, and various views an exemplary attaching device and various parts thereof are illustrated in FIGS. 1 to 9. As shown in FIGS. 1 and 2, the attaching device 10 for removably attaching a display object (schematically indicated by phantom lines in FIG. 2) to a button of a hat includes a fastener 12 and a spring member 14. As shown in FIGS. 3-6, the fastener 12 is in the form of a plastic ring 200 with a predetermined height, a plurality of fins 202 projecting radially from a top rim of the plastic ring 200, and a plurality of tabs 204 extending from a bottom rim of the plastic ring 200. Preferably, the tabs 204 are formed under the spaces between adjacent fins 202; and therefore, the fins 202 and the tabs 204 alternatively and radially protrude from the top rim and the bottom rim of the plastic ring 200 along the outer perimeter of the plastic ring 200. In one embodiment, the central portions of tabs 204 are recessed to result in a fork-like cross section with two split tips 204*a* as shown in FIGS. 3-4. The fastener 12 further comprises a flange 206 extending about a bottom rim of the plastic ring 200. The flange 206 extends from the split tips 204*a* of the tabs 204 and connected the plastic ring 200 via the tabs 204. As shown in the top view of FIG. 4, the radial extent of the projection fins 202 is substantially the same as that of the tips 204*a* of the tabs 204.

Figure 7:
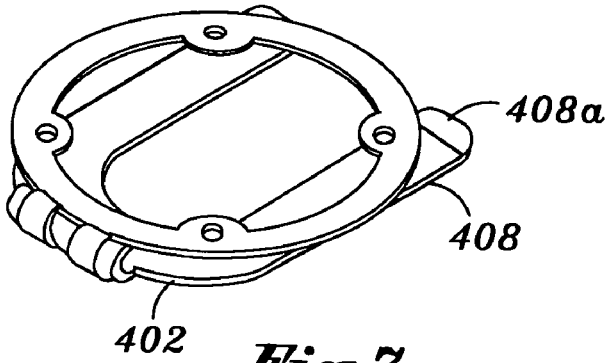
FIGS. 7-9 shows various views of a spring member of the attaching device.
Figure 8:
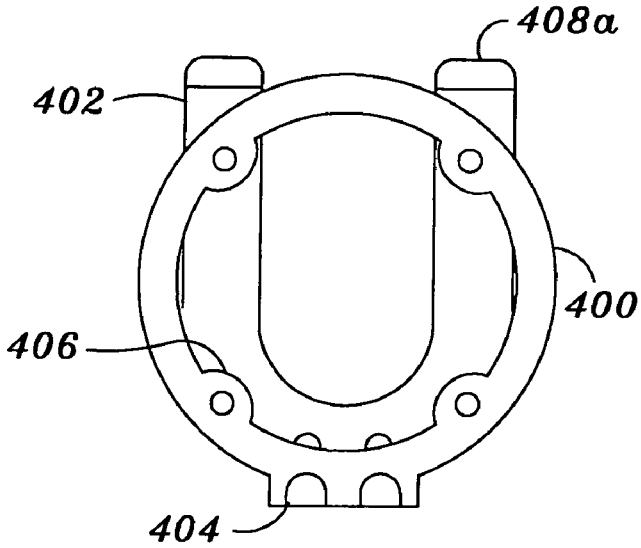
Figure 9:
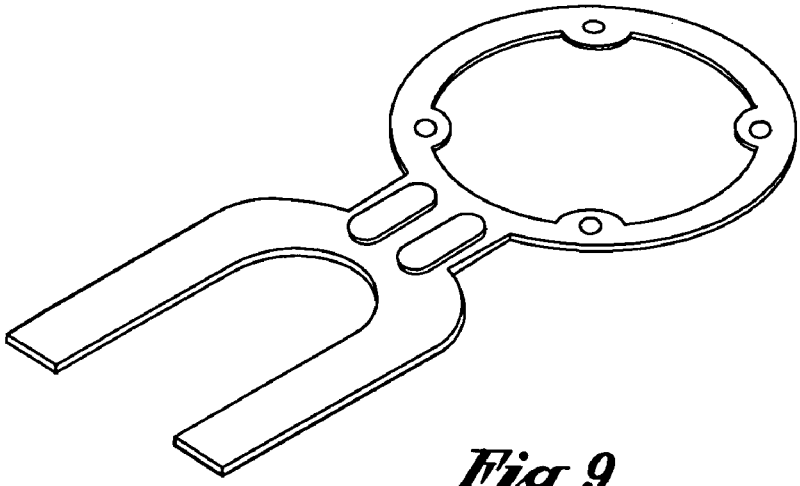

Preferably, the spring member 14 is made by folding a flat spring sheet 40 as shown in FIG. 9. The flat spring sheet 40 is configured into three continuous portions, a flat annular ring, a neck joint, and a U-shape structure. The flat spring sheet 40 is then folded to bring the flat annular ring to overlay with the U-shape structure. As shown in FIGS. 7 and 8, the flat annular ring is defined as the upper spring 400, the U-shape structure defined as the lower spring 402, and the neck is defined as the joint spring 404 extending perpendicularly to connect the upper spring 400 and the lower spring 402. As shown, the upper spring 402 further includes a plurality of protrusions 404 extending inwardly from an inner perimeter thereof. As shown in FIG. 1, the protrusions 404 are outlined with a profile for mating the tabs 204, so as to interlock the spring member 14 with the fastener 12. Therefore, the inner diameter of the upper spring 400 is substantially the same as the maximum radial extent of the tabs 204. Further, as the flange 206 radially extends over the inner perimeter of the upper spring 400, and the outer perimeter of the upper spring 400 is larger than that of the flange 206, the fastener 12 can thus be prevented from slipping through the upper ring 400 of the spring member 14.

The lower spring 402 has a proximal end connected to the upper spring 400 via the joint spring 406 and a distal end split into two parallel leaves 408. The open ends of the leaves 408 are curved upwardly to avoid an object to slide through. Therefore, when the lower spring member 406 is slid through underneath the button 12, the button 12 on the lower spring 402 is prevented from sliding away from the spring member 14. In addition, as shown in FIGS. 7-9, the joint spring 406 includes two ridges 406*a* formed thereon to increase the spring strength thereof.

In one embodiment, the fastener 12 is partially embedded within a bottom portion of a display object. Preferably, the display object has an opening extending axially from the bottom thereof. Mating slots can be formed on the inner sidewall of the display object for interlocking with the fins 202 formed at the top form of the plastic ring 200. The display object may also be designed with a bottom edge operative to press or snap fit with the fastener 12. When the mechanical interlocking or fastening structures are unavailable, or when a permanent attachment between the display object and the fastener 12 is desired, glue or adhesive can be used to adhere the display object with the fastener 12. When the display object is securely attached to the fastener 12, the leaves 408 of the lower spring 402 are slid manually under the button 12 along two opposing sides thereof. Typically, the vertical distance between the upper spring 400 and the lower spring 402 is slightly smaller than the height of the button. Therefore, the joint spring 404 is forced to flex until the vertical extent space between the upper spring member 400 and the lower spring 402 is large enough allowing the button to be received therein.

When the lower spring member 400 is slid to a position that the button is aligned with the opening of the plastic ring 200, the excessive height of the button is received within the opening of the display object. Therefore, the joint spring 406 is released to its original position to restores the original vertical distance of the space. As the tips 408*a* of the lower spring 402 are curved upwardly, plus that a portion of the button is received within the opening of the display object, the attaching device 10 is securely engaged with the button. In the condition that the display object does not have an opening or only has shallow opening, when the button is aligned and received within the plastic ring 200, release of the joint spring 406 cause the upper spring 400 and the lower spring 402 exerting a force against each other to restore the original vertical distance. As the height of the button is larger then the original vertical distance, the button is continuously secured between the upper spring 400 and the lower spring 402 by the restoration force exerted thereby.

Figure 10:
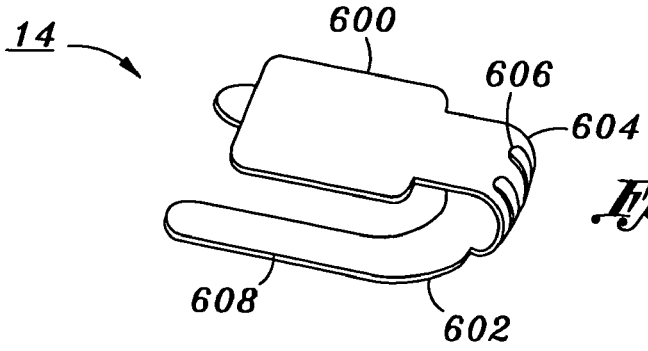
FIG. 10 shows a modification of the spring member.
Figure 11:
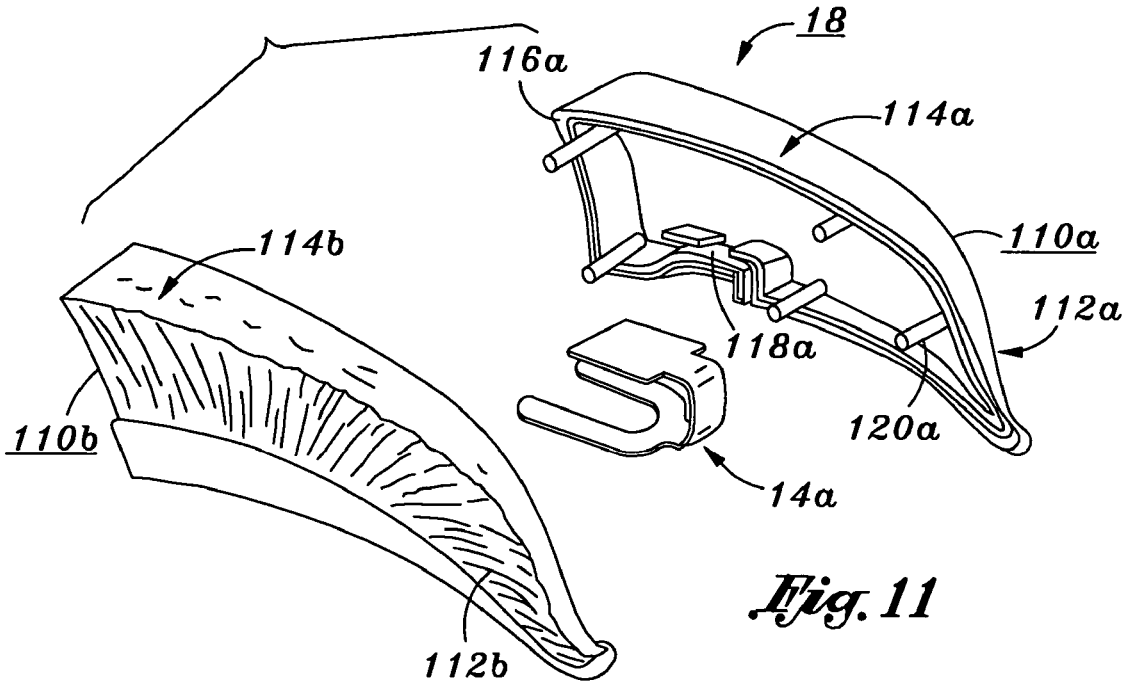
FIG. 11 shows the application of the modified spring member as an attaching device for attaching an object to a hat.
Figure 12:
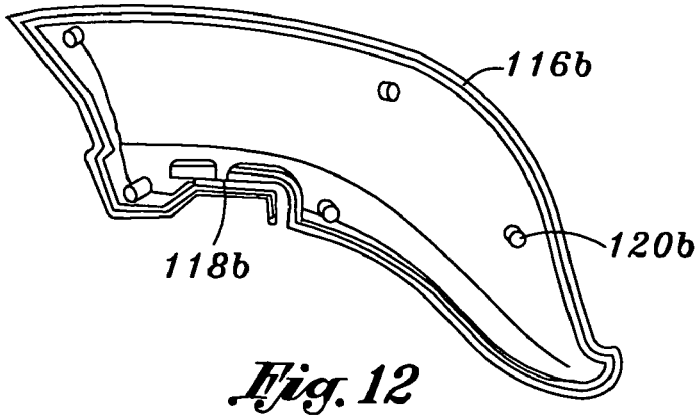
FIG. 12 shows an interior structure of the object as shown in FIG. 11.

FIG. 10 shows a modification of the spring member 14. As shown in FIG. 14, the modified spring 14*a* includes an upper spring portion 600, a lower spring portion 602, and a joint spring portion 604. In this embodiment, the upper spring portion 600 is configured into a flat tab to be engaged with a display object 18 (as shown in FIGS. 11 and 12). The lower spring portion 602 has a proximal end extending from the bottom end of joint spring portion 604 and a distal end split into two parallel arms or leaves 608. The vertical extent of the space between the upper spring portion 600 and the lower spring portion 602 is substantially the same, or slightly smaller than the height of the button of the hat, and the lower spring portion 602 extend longer and wider than the upper spring portion 600. Similarly, ridges 606 are preferably formed and extending vertically on the joint spring portion 604 for increasing the spring strength. Therefore, to attach the spring member 14*a* to the button of the hat, the split leaves 608 are position at two sides of the button, the joint spring portion 604 is bent to open up the space between the upper spring portion 600 and the lower spring portion 602, such that the spring member 14*a* can slide towards the button with the upper and lower spring portions 600 and 602 moving above and under the button, respectively, until the button is totally covered by the upper spring portion 600. The joint spring portion 604 is then released to exert a force restoring the original positions of upper and lower spring portions 600 and 602. However, as the space between the original positions of the upper spring portion 600 and the lower spring portion 602 is no larger than the height of the button, the restoration force will be continuously exerted to press the upper spring portion 600 and lower spring portion 602 against the button sandwiched therein. Thereby, a secure attachment between the spring member 14*a* and the hat button is obtained.

As shown in FIG. 11, the modified spring member 14*a* can be used to directly engage with a display object 11 and attach the display object to a button of a hat. The display object 11 includes two mating parts 110*a* and 110*b* laterally detachable from each other. In this embodiment, the mating parts 110*a* and 110*b* are in the form of two symmetric shells each having a substantially flat side surface 112*a* and 112*b* and a peripheral surface 114*a* and 114*b* extending perpendicularly from the edge of the side surface 110*a* and 110*b* and terminated with an open rims 116*a* and 116*b*, respectively. To engage with the spring member 14*a*, the bottom portions of the peripheral surfaces 114*a* and 114*b* are configured to form a pair of slots 118*a* and 118*b* for receiving the at least the upper spring portion 600 of the spring member 14*a* therein. Preferably, the slots 118*a* and 118*b* are configured to receive both the upper spring portion 600 and the joint spring portion 606 therein, such that the spring member 14 can be securely embedded within the display object 11. As the joint spring portion 606 is connected to the lower spring portion 604, each of the slots 118*a* and 118*b* terminated with at least one open end.

In the embodiment as shown in FIGS. 11 and 12, the bottom portions of the peripheral side surfaces 114*a* and 114*b* are constructed by two segments with the distal ends extending from two opposing ends of the display object 11, and the proximal ends bent and overlapped with each other to form the slot 118*a* and 118*b* for receiving the upper and joint spring portions 600 and 606.

Thus designed, the spring member 14*a* can be embedded within the display object 11 by aligning the slots 118*a* and 118*b* with the upper and joint spring portions 400 and 406, followed by laterally approaching the mating parts 110*a* and 110*b* towards the spring member 14*a*. As shown in FIG. 11 and 12, fastening or latching means such as a plurality of protruding posts 120*a* and a plurality of mating sleeves 120*b* can be formed on the interior side of the side surfaces 112*a* and 112*b*, respectively.

The above description is given by way of example, and not limitation. Given the above disclosure, one skilled in the art could devise variations that are within the scope and spirit of the invention disclosed herein, including various ways of attaching the attaching device to the display object. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A hat accessory, comprising:

a spring member, comprising:

an upper spring portion defining first and second portions;

a lower spring portion underlying the upper spring portion, wherein the lower spring portion has one end split into two parallel leaves and the other end connected to the upper spring portion; and a joint spring portion for connecting the other end of the lower spring portion to one end of the upper spring portion; and a display object comprising first and second mating parts detachable from each other, wherein the first mating part has a first bottom portion defining a first slot, the second mating part has a second bottom portion defining a second slot, the first and second slots of the first and second mating parts simultaneously receiving first and second portions of the upper spring portion for embedding the upper spring portion of the spring member to the display object.

2. The hat accessory of claim 1, wherein each of the mating parts further comprises a side surface and a plurality of latching structures protruding from an interior side of the side surface.

3. The hat accessory of claim 2, wherein the latching structures includes a plurality of protruding posts formed in one of the mating parts and a plurality of receiving sleeves formed in the other mating parts.

4. The hat accessory of claim 1 wherein the first and second portions of the upper spring portion has a generally flat configuration.

5. The hat accessory of claim 4 wherein the upper spring portion is generally parallel to the lower spring portion.

6. The hat accessory of claim 1 wherein the first and second portions of the upper spring portion fits snugly within the first and second slots of the first and second mating parts to mitigate against movement of the spring member and the display object during use.

7. The hat accessory of claim 1 wherein the upper spring portion is disposed directly above the lower spring portion.

* * * * *